US006899461B2

(12) United States Patent
Kasai

(10) Patent No.: US 6,899,461 B2
(45) **Date of Patent: *May 31, 2005**

(54) SLIDER OF PLASTIC CHUCK, BAG BODY WITH SLIDER, AND METHOD OF MANUFACTURING THE BAG BODY

(75) Inventor: Juichi Kasai, Tokyo (JP)

(73) Assignee: Showa Highpolymer Co., Ltd., Tokyo (JP)

( * ) Notice: Subject to any disclaimer, the term of this patent is extended or adjusted under 35 U.S.C. 154(b) by 4 days.

This patent is subject to a terminal disclaimer.

(21) Appl. No.: 10/344,559

(22) PCT Filed: Aug. 21, 2001

(86) PCT No.: PCT/JP01/07164

§ 371 (c)(1),
(2), (4) Date: Feb. 20, 2003

(87) PCT Pub. No.: WO02/15733

PCT Pub. Date: Feb. 28, 2002

(65) Prior Publication Data

US 2003/0161553 A1 Aug. 28, 2003

(30) Foreign Application Priority Data

Aug. 21, 2000 (JP) ..... 2000-249253

(51) Int. Cl.[7] ..... B65D 33/16
(52) U.S. Cl. ..... 383/64; 24/399
(58) Field of Search ..... 383/64; 24/399–400; 493/214

(56) References Cited

U.S. PATENT DOCUMENTS

| | | | | |
|---|---|---|---|---|
| 5,067,208 A | | 11/1991 | Herrington, Jr. et al. | |
| 5,167,608 A | * | 12/1992 | Steffens et al. | 493/214 |
| 5,871,281 A | * | 2/1999 | Stolmeier et al. | 383/64 |
| 5,996,187 A | | 12/1999 | Tanaka et al. | |
| 6,047,450 A | | 4/2000 | Machacek et al. | |
| 6,287,000 B1 | * | 9/2001 | Buchman | 383/5 |
| 2004/0010893 A1 | * | 1/2004 | Kasai | 24/438 |

FOREIGN PATENT DOCUMENTS

| | | |
|---|---|---|
| EP | 941937 | 9/1999 |
| JP | 77518/1994 | 11/1994 |

* cited by examiner

*Primary Examiner*—Jes F. Pascua
(74) *Attorney, Agent, or Firm*—Oblon, Spivak, McClelland, Maier & Neustadt, P.C.

(57) ABSTRACT

There is disclosed a slider for a plastic zipper, including an inside guide which is inserted between a pair of male hook and female hook of a plastic zipper, functions so as to disengage the male hook and female hook from each other by the sliding movement of the slider, is installed on the slider main body rotatably about an axis perpendicular to the plastic zipper, and is capable by the rotation, of being located at a prescribed position where it functions as such or being dislocated from the above prescribed position.

The above slider is easily attachable to a plastic zipper at a rate higher than a bag manufacturing rate, and is prevented from falling-off even if a small plastic zipper is formed of a thin film with low strength.

17 Claims, 27 Drawing Sheets

SLIDER OF PLASTIC CHUCK, BAG BODY WITH SLIDER, AND METHOD OF MANUFACTURING THE BAG BODY

TECHNICAL FIELD

The present invention relates to a slider for a bag body which is equipped with a plastic zipper and which is employed as packaging materials for a variety of articles in the fields of foods, pharmaceuticals, electronic part items and the like; a bag body equipped with a plastic zipper having the aforesaid slider; and a process for producing the bag body.

BACKGROUND ART

Bag bodies each equipped with a plastic zipper having a slider are widely employed for a variety of articles in the fields of foods, pharmaceuticals, electronic part items and the like. There have hitherto been proposed various items relating to the structure of this kind of plastic zipper and a slider for opening and closing the same {for instance, Japanese Patent Application Laid-Open No. 214920/1996 (Heisei 8)}. In general, the structure of a plastic zipper is constituted as illustrated on FIG. 16 through FIG. 20.

That is to say, FIG. 16 is a perspective cross sectional view showing the principal portions of a conventional bag body equipped with a slider. FIG. 17, FIG. 18, FIG. 19 and FIG. 20 are each a cross sectional view taken along line E–E' of FIG. 16, a cross sectional view taken along line F–F' thereof, a cross sectional view taken along line G–G' thereof and a cross sectional view taken along line H–H' thereof.

In the FIG. 16 through FIG. 20, the slider S which is usually comprised of an outside guide 6-1 that is built in a slider main body Sh and an inside guide 6-2 that is inserted between the male hook and the female hook of the plastic zipper in such a structure to disengage the male/female hooks, while the outside guide 6-1 causes the male/female hooks to engage and at the same time, prevent the slider falling off from the zipper. That is to say, the outside guide 6-1 slidably nippes both sides of the plastic zipper so as to engage the male/female hooks, and the outside guide 6-1 also nippes the lower portion of the zipper, namely the anti-falling-off portion 6-1-1 to prevent the slider falling off from the zipper.

In order to attach the slider to a bag body equipped with the plastic zipper in an automatic and mass-producible manner, it is necessary to attach the slider simultaneously with bag manufacture in the case of manufacturing bags with a bag manufacturing machine. Since the manufacturing rate of a bag manufacturing machine is usually about 60 bags per minute, a slider attaching rate is required to be comparable thereto or more than the same.

However, since simultaneous attachment of the inside guide at an opening portion of the zipper and the outside guide at a closing portion of the zipper necessitates a considerably troublesome steps, it is difficult to simultaneously satisfy the above-mentioned requirements. In particular in the case of thin zipper portion with small slider, the slider attaching rate is markedly decreased to an uneconomical level.

In addition, the case where it is possible to use the above-mentioned slider having the anti-falling-off portion 6-1-1 in such form that a portion of the outside guide slidably nippes the lower portion of the zipper has been limited to a case where the size of the zipper is so large as to be capable of preventing the slider from falling off, and also to such a case where the film on which the hooks of the zipper are formed has favorable sliding properties and strength.

That is to say, the slider as mentioned above suffers from a serious disadvantage that it is unusable in the case of a small zipper portion and a film on which the zipper portion is formed and which has a small thickness or poor sliding properties, because of damage to the film or falling-off of the slider.

Moreover, the existence of the anti-falling-off portion causes further intricateness and difficulty to attaching procedure of the slider as well as remarkable decrease in slider attaching rate.

There is also known a slider which is used for a conventional plastic zipper and to which is applied anti-falling-off structure for sliders.

Specifically, FIG. 21 is a perspective view showing a conventional zipper. FIG. 22 and FIG. 23 are each a cross sectional view taken along line I–I' of FIG. 21 and a cross sectional view taken along line J–J' thereof. FIG. 24 and FIG. 25 are each a cross sectional view taken along line K–K' of FIG. 22 and a cross sectional view taken along line L–L' of FIG. 23. In this case, the lower portion of the slider extends to the engaged portion of the zipper, thereby preventing falling-off thereof.

FIG. 26 and FIG. 27 each show an example of a slider for a conventional plastic zipper equipped with an anti-falling-off structure for the slider and are each a cross sectional view taken along line F–F' of FIG. 16 (similar to FIG. 18) and a cross sectional view taken along line H–H' of FIG. 16 (similar to FIG. 20). As can be seen from the figures, the tip portion 6-2-1 of the inside guide 6-2 is inserted beneath the zipper engaging portion, thereby preventing falling-off of the slider.

With such a structure, the slider falling-off can be prevented even in the case of a small-sized zipper. Nevertheless it is remarkably difficult to simultaneously carry out two contradictory procedures wherein for the sake of attaching the slider to the zipper, on the one hand the zipper needs to be opened to insert the inside guide, and on the other hand the tip portion of the inside guide must be inserted into the inside of the closed zipper. Hence taking into consideration the slider attaching rate, the industrial implementation thereof is extremely difficult.

The object of the present invention is to provide a slider for a plastic zipper, a bag body equipped with the aforesaid slider and a process for producing the bag body, wherein the slider can easily be attached to the plastic zipper at a rate higher than a bag manufacturing rate, and further is free from a fear of falling off even if the plastic zipper is slender and is formed of a film having a thin material and low strength.

DISCLOSURE OF THE INVENTION

The slider according to the present invention to be attached to a plastic zipper is detailed as follows.

1. A slider which is attached to a plastic zipper composed of a pair of male hook and female hook that are formed on the surface of plastic films for the purpose of opening and closing said plastic zipper, comprising a slider main body; an inside guide which is fastened to the slider main body, is inserted between said hooks of the plastic zipper and functions so as to disengage the male hook and female hook from each other by the sliding movement of the slider; and an outside guide which is placed at a position nipping said hooks of the plastic zipper, and functions so as to engage said hooks with each other by the sliding movement of the slider, wherein the inside guide is installed on the slider main body rotatably about an axis perpendicular to the plastic zipper, and is capable of being located at a prescribed position where it functions by said rotation or being dislocated from said position;

2. The slider as set forth in the preceding item 1, wherein the inside guide is installed on part of the upper wall portion of the slider main body via a flexural portion in an openable/closable manner;
3. The slider as set forth in the preceding item 1 or 2, wherein the outside guide is of such a shape that prevents the slide from falling-off by the lower portion of the zipper nipped in the outside guide; and
4. The slider as set forth in the preceding item 1 or 2, wherein the inside guide is of such a shape that is projected so as to be positioned at the outside guide beneath the zipper closing portion when the inside guide is located at a prescribed position where it functions as such.

The bag body equipped with the plastic zipper having the slider according to the present invention is detailed as follows.

5. A bag body equipped with a plastic zipper having the slider for opening and closing the plastic zipper, wherein the slider is that as set forth in any of the preceding items 1 through 4, and an inside guide fastened to a slider main body rotatably about an axis perpendicular to the plastic zipper is located at a prescribed position where it functions as such by said rotation.

The process for producing the bag body according to the present invention which is equipped with the plastic zipper having the slider is detailed as follows.

6. A process for producing a bag body equipped with a plastic zipper having the slider, comprising at the time of producing the bag body equipped with the plastic zipper, attaching an outside guide of the slider to a plastic zipper in a closed state in a state that an inside guide is dislocated from a prescribed position where it functions as such by using the slider for the plastic zipper as set forth in any of the preceding items 1 through 4, subsequently opening the zipper, and placing the inside guide at a prescribed position between the hooks of the zipper where the inside guide functions as such by rotating the same in the aforesaid state.

Figure 1:
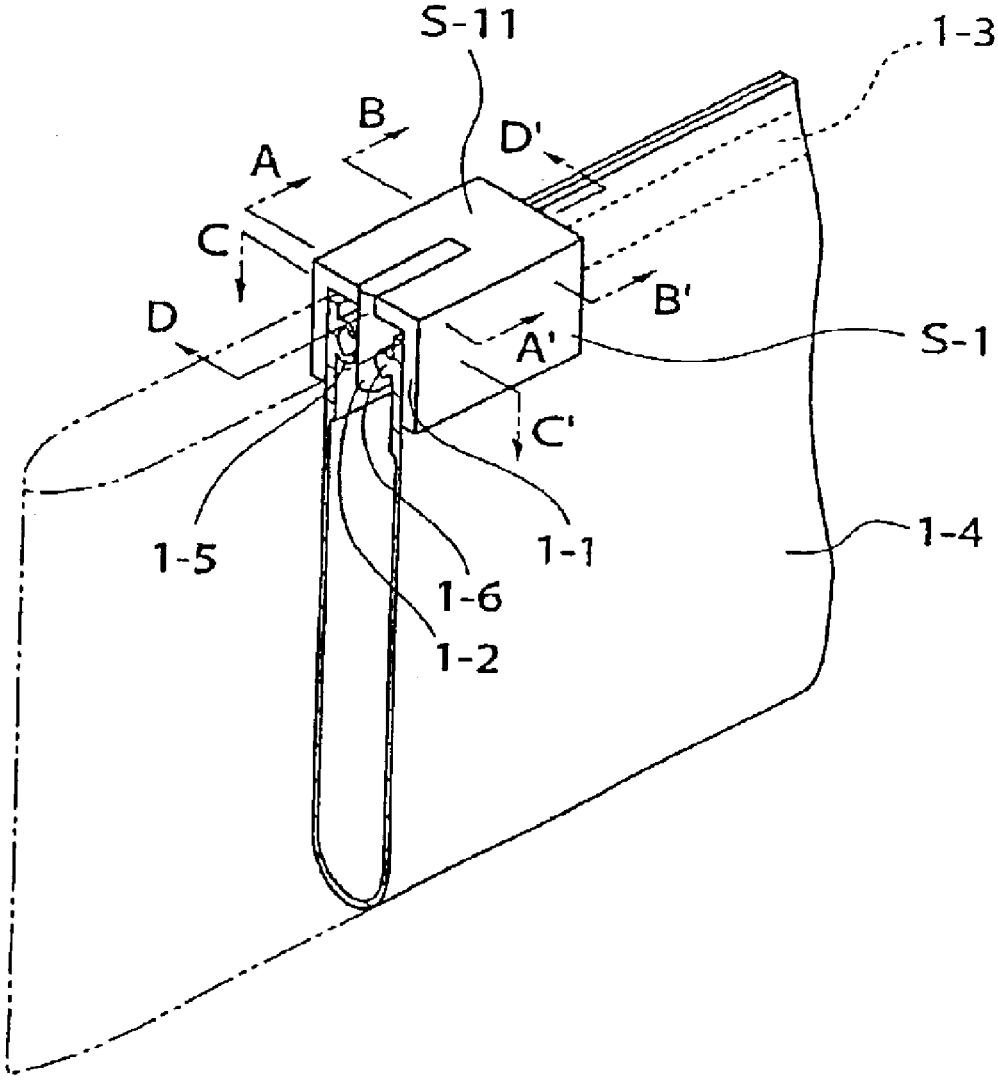
FIG. 1 is a perspective cross sectional view of the principal portions showing an embodiment of a slider, a plastic zipper with a slider and a bag body equipped with the plastic zipper each being related to the present invention.

| DESCRIPTION OF THE SYMBOLS IN THE DRAWINGS | |
|---|---|
| S 1: | slider |
| S 11: | slider main body |
| S 11a: | upper wall portion |
| 1 - 1: | outside guide |
| 1 - 1 - 1: | anti-falling-off portion of slider |
| 1 - 2: | inside guide |
| 1 - 2 - 1: | flexural portion |
| 1 - 2 - 2: | inside guide extension portion |
| 1 - 4: | bag body |
| 1 - 5: | female hook |
| 1 - 6: | male hook |
| 4 - 2 - 1: | opening bill |
| 4 - 2 - 2: | opening bill |
| 4 - 2 - 3: | closing bill |
| 5 - 1 - 1: | film equipped with zipper |
| 5 - 1 - 2: | roll |
| 5 - 1 - 3: | dancer roll |
| 5 - 1 - 4: | ultrasonic heat sealing apparatus |
| 5 - 1 - 5: | roll |
| 5 - 1 - 6: | melt cut sealing apparatus |
| 5 - 1 - 7: | bag body |
| S: | conventional slider |
| Sh: | conventional slider main body |
| 6 - 1: | outside guide |
| 6 - 1 - 1: | anti-falling-off portion of slider |
| 6 - 2: | inside guide |
| 6 - 2 - 1: | inside guide extension portion |

THE MOST PREFERRED EMBODIMENT TO CARRY OUT THE INVENTION

In the following, some description will be given of the embodiments according to the present invention.

Figure 2:
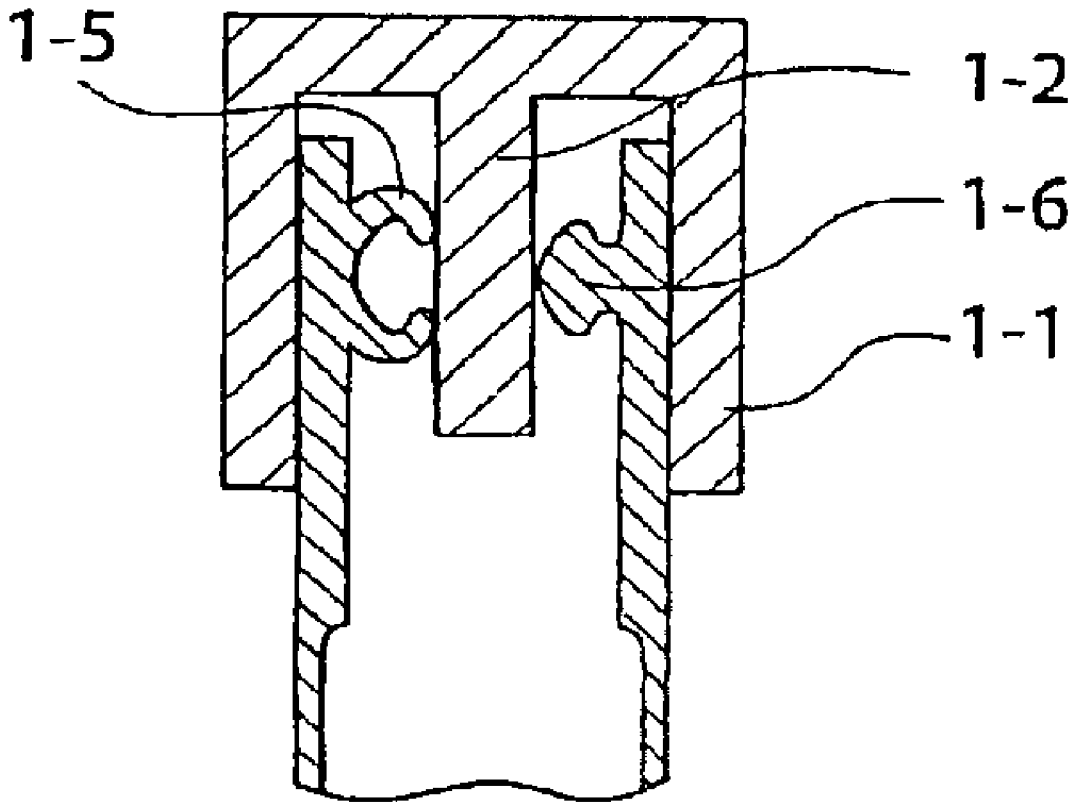
FIG. 2 is a cross sectional view which is taken along line A–A' of FIG. 1 and which shows an embodiment of a slider.
Figure 3:
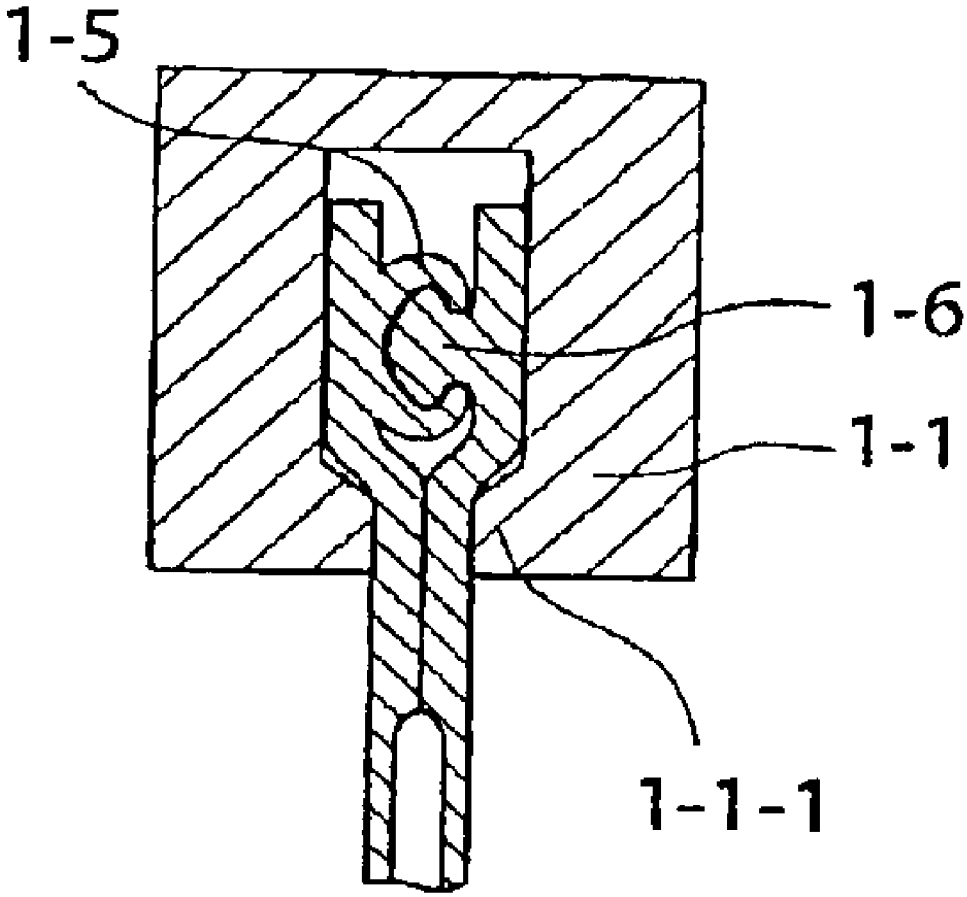
FIG. 3 is a cross sectional view which is taken along line B–B' of FIG. 1 and which shows an embodiment of a slider.
Figure 4:
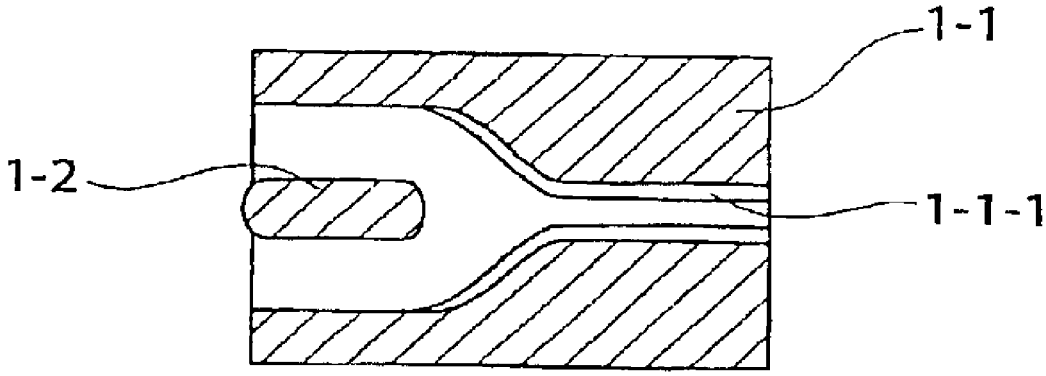
FIG. 4 is a cross sectional view which is taken along line C–C' of FIG. 1 and which shows an embodiment of a slider.
Figure 5:
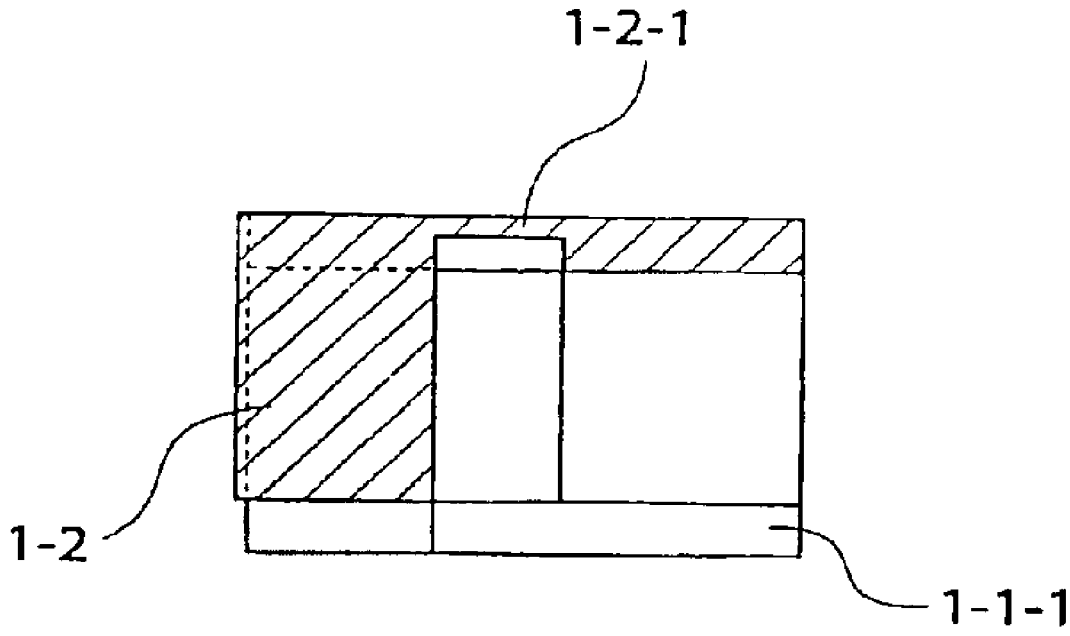
FIG. 5 is a cross sectional view which is taken along line D–D' of FIG. 1 and which shows an embodiment of a slider.
Figure 6:
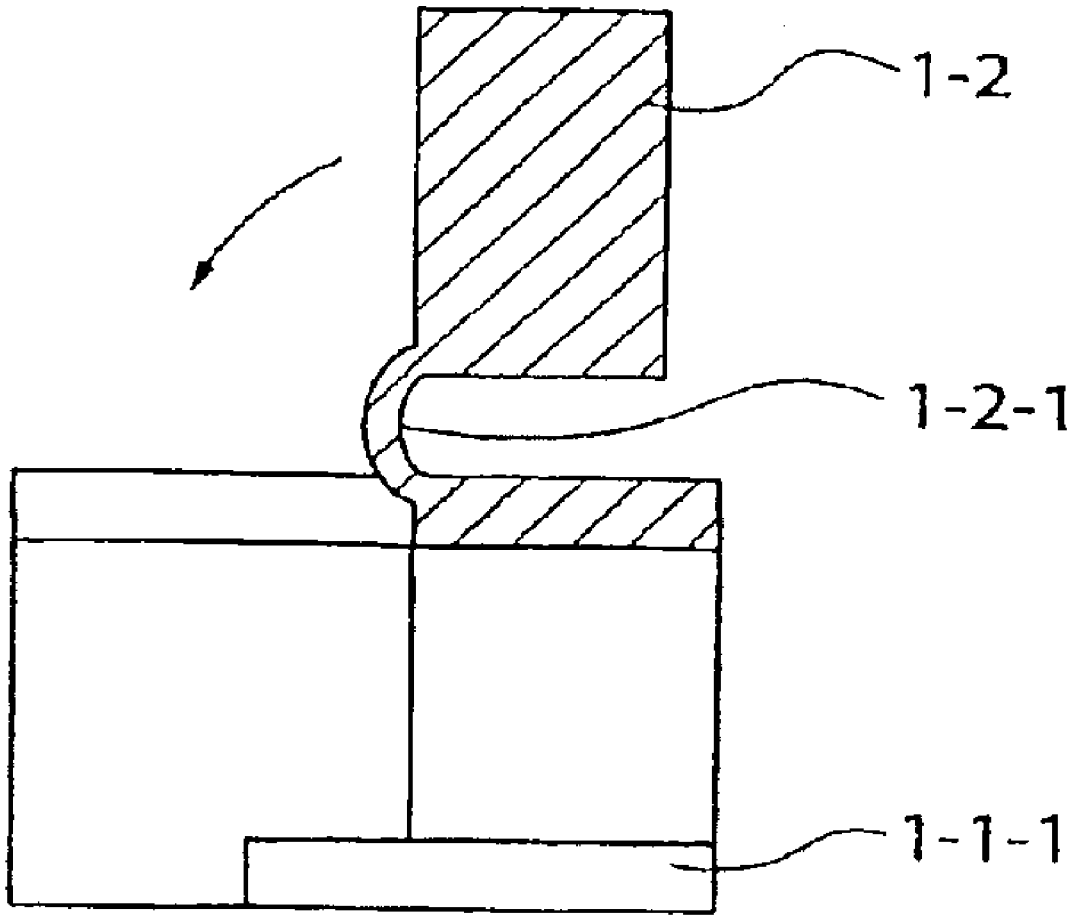
FIG. 6 is a cross sectional view which is taken along line D–D' of FIG. 1 and which shows an embodiment of a slider wherein the position of the inside guide is different from that in FIG. 5.
Figure 7:
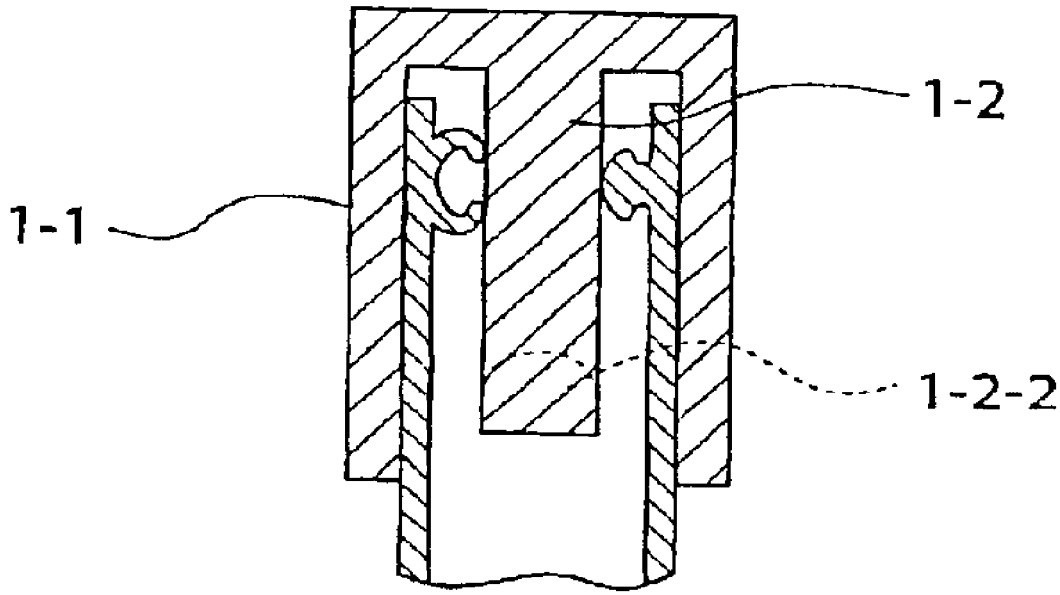
FIG. 7 is a cross sectional view which is taken along line A–A' of FIG. 1 and which shows an embodiment of a slider other than therein.
Figure 8:
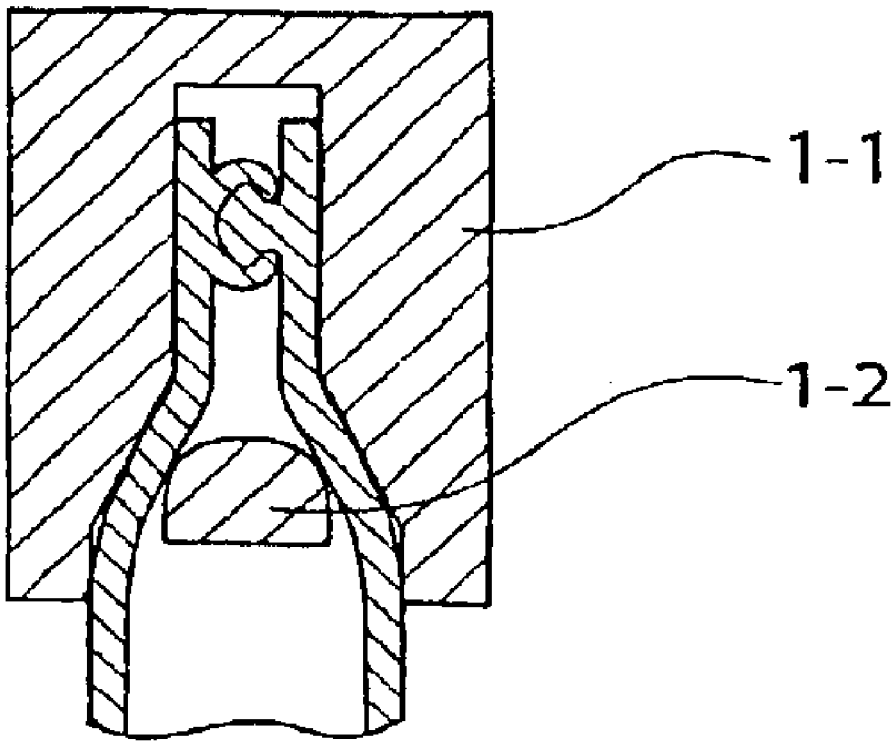
FIG. 8 is a cross sectional view which is taken along line B–B' of FIG. 1 and which shows an embodiment of a slider other than therein.
Figure 9:
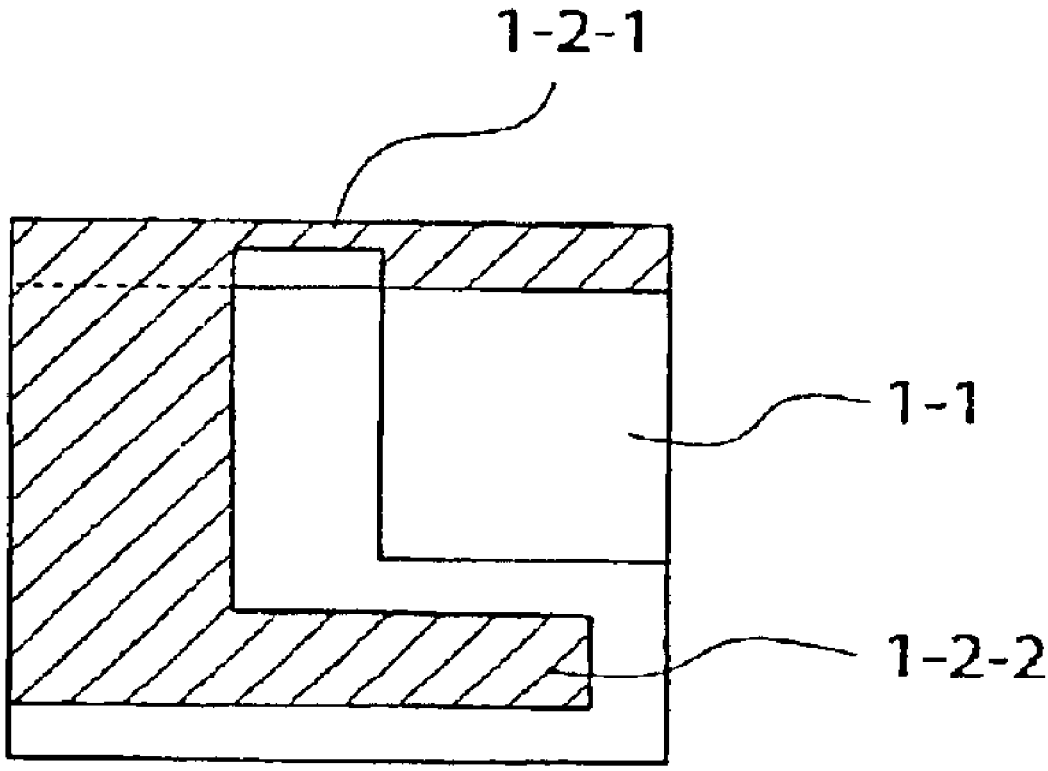
FIG. 9 is a cross sectional view which is taken along line D–D' of FIG. 1 and which shows an embodiment of a slider other than therein.
Figure 10:
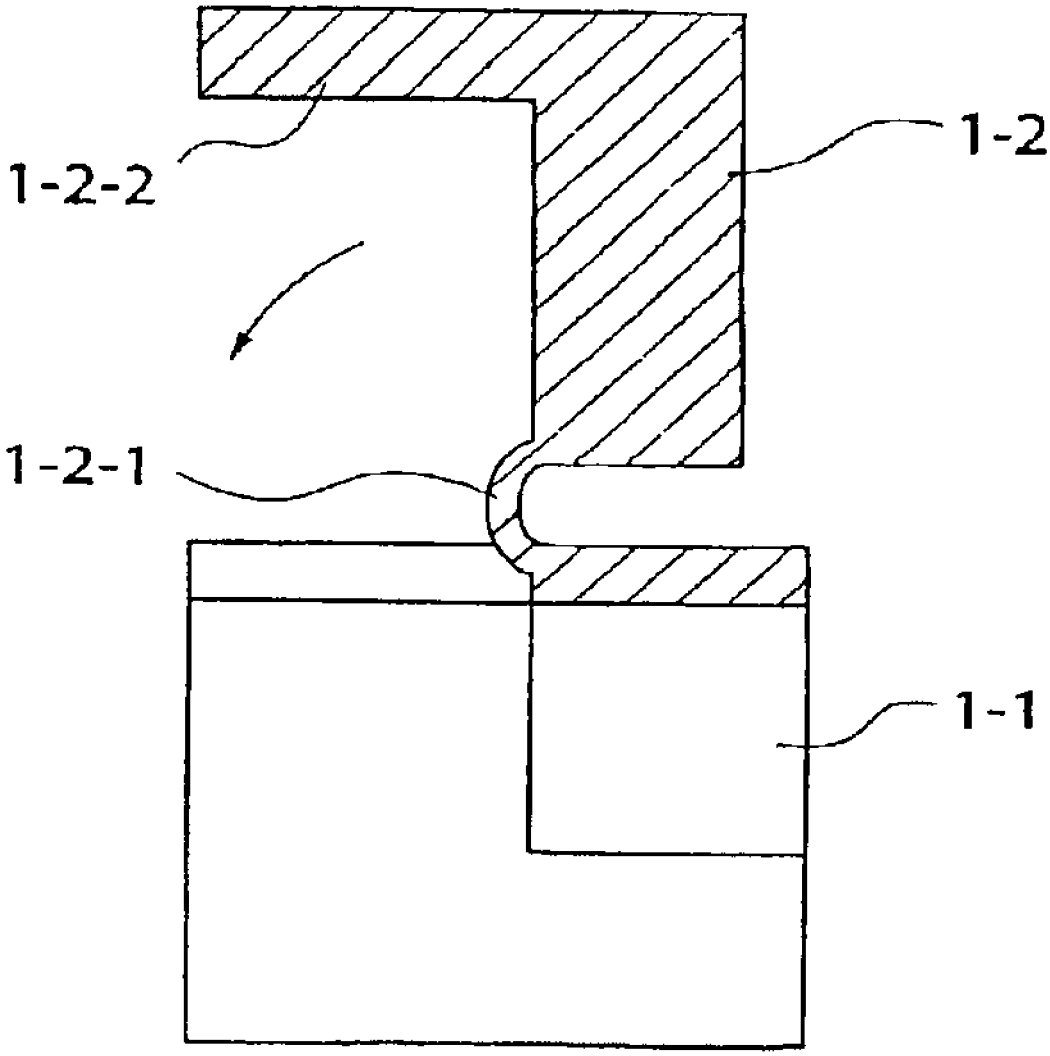
FIG. 10 is a cross sectional view which is taken along line D–D' of FIG. 1 and which shows an embodiment of a slider other than therein wherein the position of the inside guide is different from that in FIG. 9.

FIG. 1 is a perspective cross sectional view of the principal portions showing an embodiment according to the present invention. Therein, 1-4 is a bag body, which is equipped with a plastic zipper composed of a male hook 1-6 and female hook 1-5, and which shows a state 1-3 of closed zipper. Also therein, S1 is a slider which opens and closes the above-mentioned plastic zipper, 1-1 is an outside guide of the slider, 1-2 is an inside guide thereof. FIG. 2 is a cross sectional view taken along line A–A' of FIG. 1, FIG. 3 is a cross sectional view taken along line B–B' of FIG. 1, FIG. 4 is a cross sectional view taken along line C–C' of FIG. 1, FIG. 5 is a cross sectional view which is taken along line D–D' of FIG. 1, and which shows a state in which the inside guide 1-2 is located at a prescribed position where the inside guide functions as such. FIG. 6, although is a cross sectional view taken along line D–D' of FIG. 1 (the same as in FIG. 5), shows a state in which the inside guide 1-2 is dislocated from a prescribed position where the inside guide functions as such, that is, a state before the inside guide 1-2 is located at a prescribed position where it functions as such.

In order to attach the above-mentioned sliders S1 to the plastic zippers of bag bodies 1-4 each equipped with a zipper in a mechanical and mass-producible manner, it is necessary to attach the sliders thereto simultaneously with bag manufacturing by means of a bag manufacturing machine. Since a bag manufacturing rate by means of a bag manufacturing machine is generally about 60 bags per minute, a slider attaching rate needs to be comparable thereto or more than the same. In order to solve the above-mentioned subject according to the present invention, the inside guide 1-2 is rotatably mounted on the slider main body S-11 so that the inside guide is rotated about an axis perpendicular to the plastic zipper, and is inserted between the hooks 1-5, 1-6 to assemble the zipper having the slider at the time of attaching the slider main body S-11 to the plastic zipper.

Specifically as illustrated on FIG. 5 and FIG. 6, the slider S1 is formed in advance by separating the inside guide portion (1-2) and outside guide portion (1-1) from each other and connecting both the portions with a hinge-shaped flexural portion 1-2-1, then firstly the slider S1 is attached to the plastic zipper in a state as illustrated on FIG. 6, and subsequently the inside guide 1-2 is inserted between the hooks of the zipper by rotating the hinge-shaped flexural portion 1-2-1 in the direction of the arrow about an axis perpendicular to the plastic zipper, so that the inside guide is located at a position where it functions as such. This configuration is such that the inside guide is formed via the hinge-shaped flexural portion 1-2-1 in a state that a part of upper wall portion of the slider main body S-11 is cut out.

The embodiment as exemplified on FIG. 2 through FIG. 6 is the same as that of the conventionally well known slider as illustrated on FIG. 16 through FIG. 20 including the configuration in which the slider is prevented from falling off by the anti-falling-off portion 1-1-1 nipping the lower portion of the plastic zipper, except that the inside guide is rotatably mounted on the slider main body so that the inside guide is rotated about an axis perpendicular to the plastic zipper, and it is made possible by the aforesaid rotation to locate the inside guide at a position where it functions as such and dislocate it from the above-mentioned position.

On the other hand, FIG. 7 through FIG. 10 each illustrate an embodiment corresponding to the improved slider as illustrated on FIG. 26 and FIG. 27, and FIG. 7, FIG. 8, FIG. 9 and FIG. 10 each correspond to FIG. 2, FIG. 3, FIG. 5 and FIG. 6, respectively.

In the above-described embodiments, the lower portion of the outside guide is not equipped with the anti-falling-off portion 1-1-1 that is illustrated on FIG. 3. Instead, the falling-off of the slider is prevented by such constitution that the cross section of the inside guide 1-2 is formed in the form of almost the letter "L" as illustrated on FIG. 9 and FIG. 10 and when the inside guide is fitted into the slider by rotating the hinge-shaped flexural portion 1-2-1 from the state in FIG. 10, a part (tip portion) 1-2-2 is located beneath the closing portion of the zipper located in the outside guide 1-1 as illustrated on FIG. 8 and FIG. 9, while the contact side between the inside guide 1-2 and the zipper is in the form of arc surface.

In the following, the attachment configuration of the slider thus formed is detailed. As illustrated on FIG. 11(A), the outside guide 1-1 of the slider S1 is placed onto the zipper from the topside thereof in a closed zipper state, and subsequently as illustrated on FIG. 11(B) and FIG. 13, the zipper on the open end side of the slider S1 is opened by using opening bills 4-2-1 and 4-2-2, when the zipper is pressed by the closing bill 4-2-3 to suppress excessive opening of the zipper. The inside guide 1-2 is rotated through the hinge-shaped flexural portion 1-2-1 so that the inside guide 1-2 is fitted into the outside guide 1-1 of the slider, and thereafter the opening bills are closed. In this case as illustrated on FIG. 12, the opening bills 4-2-1 and 4-2-2 are kept in a state of contact with the topside of the zipper to prepare for next opening. The zipper, although being opened by the use of the opening bills 4-2-1 and 4-2-2 on the figures, may be opened by attracting both the outer sides of the bag onto vacuum pads.

At the moment when the inside guide 1-2 is fitted into the outside guide 1-1 of the slider, the zipper is in a closed state inside the outside guide, but it is made possible by the above-mentioned means to smoothly insert the inside guide 1-2 of the slider into the inside of the zipper in a closed state.

Accordingly it is made possible to carry out the steps of attaching the outside guide 1-1 to the zipper being closed in advance, rotatably inserting the inside guide 1-2 into the zipper which is made into an open state at the opening end of the the slider S1 and besides inserting an inside guide projecting portion 1-2-2 beneath the closed zipper portion so as to prevent the falling-off of the slider S1.

There has been described hereinbefore the example of attaching the slider as illustrated on FIGS. 7 through 10. In the case of attaching the slider as illustrated on FIGS. 2 through 6, because of its constitution in which the falling-off of the slider S1 is prevented by nipping the lower portion of the zipper at the bottom of the outside guide, the slider S1 can not be attached only by placing the outside guide 1-1 of the slider S1 on the zipper from the topside thereof, whereby another procedure is required. Even in such a case, however, the slider attaching rate can drastically be enhanced as compared with the method using a conventional type of slider.

Figure 14:
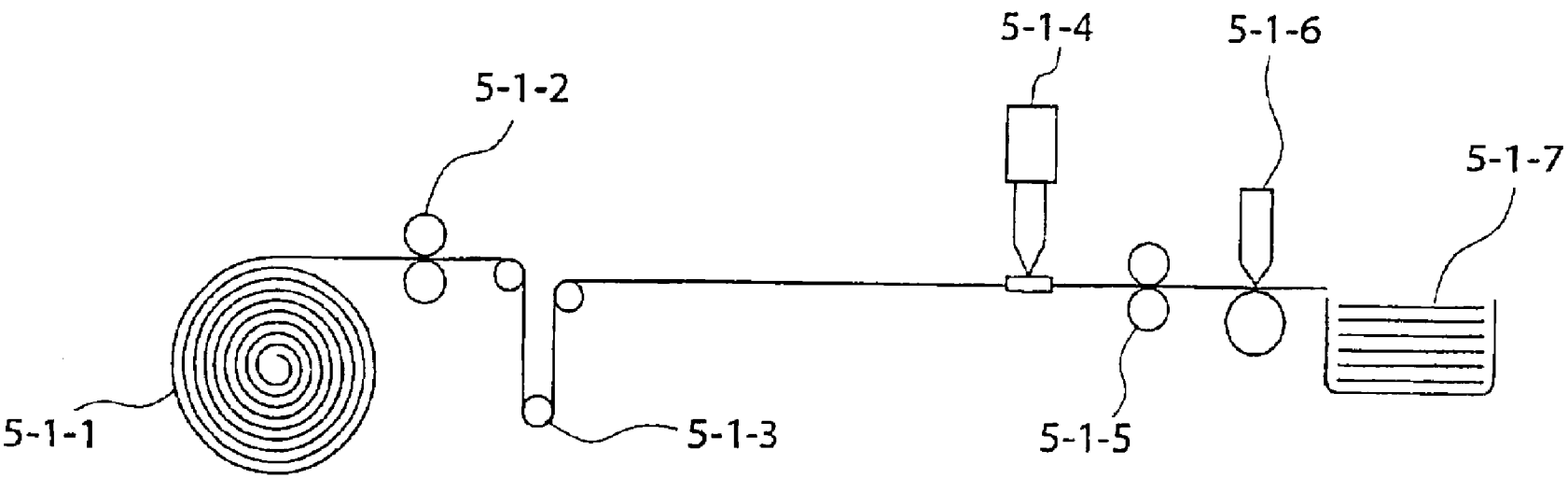
FIG. 14 is a schematic view showing a bag manufacturing process by the use of a conventional bag manufacturing machine of melt cut sealing system.

A series of operations for attaching the slider S1 to the bag body equipped with a plastic zipper are continuously carried out by using a bag manufacturing machine simultaneously with bag manufacture. In order to describe the manufacturing steps in more detail, the function of a conventional bag manufacturing machine of melt cut sealing system will be exemplified with reference to FIG. 14.

The film equipped with zipper 5-1-1, which is formed by folding a film with a zipper produced by T-die method or the like with the closed zipper placed at an end and thereafter winding the film in the form of spool, is let out with a roll 5-1-2, and is intermittently supplied to a ultrasonic heat sealing apparatus 5-1-4 via a dancer roll 5-1-3 to be used for intermittently sending out the film, so that the zipper portion is selectively heat sealed. Subsequently, the film is intermittently supplied to a melt cut sealing apparatus 5-1-6 by means of a roll 5-1-5, so that the film is fusedly bonded and simultaneously cut into bag bodies 5-1-7 as the objective products.

Figure 11:
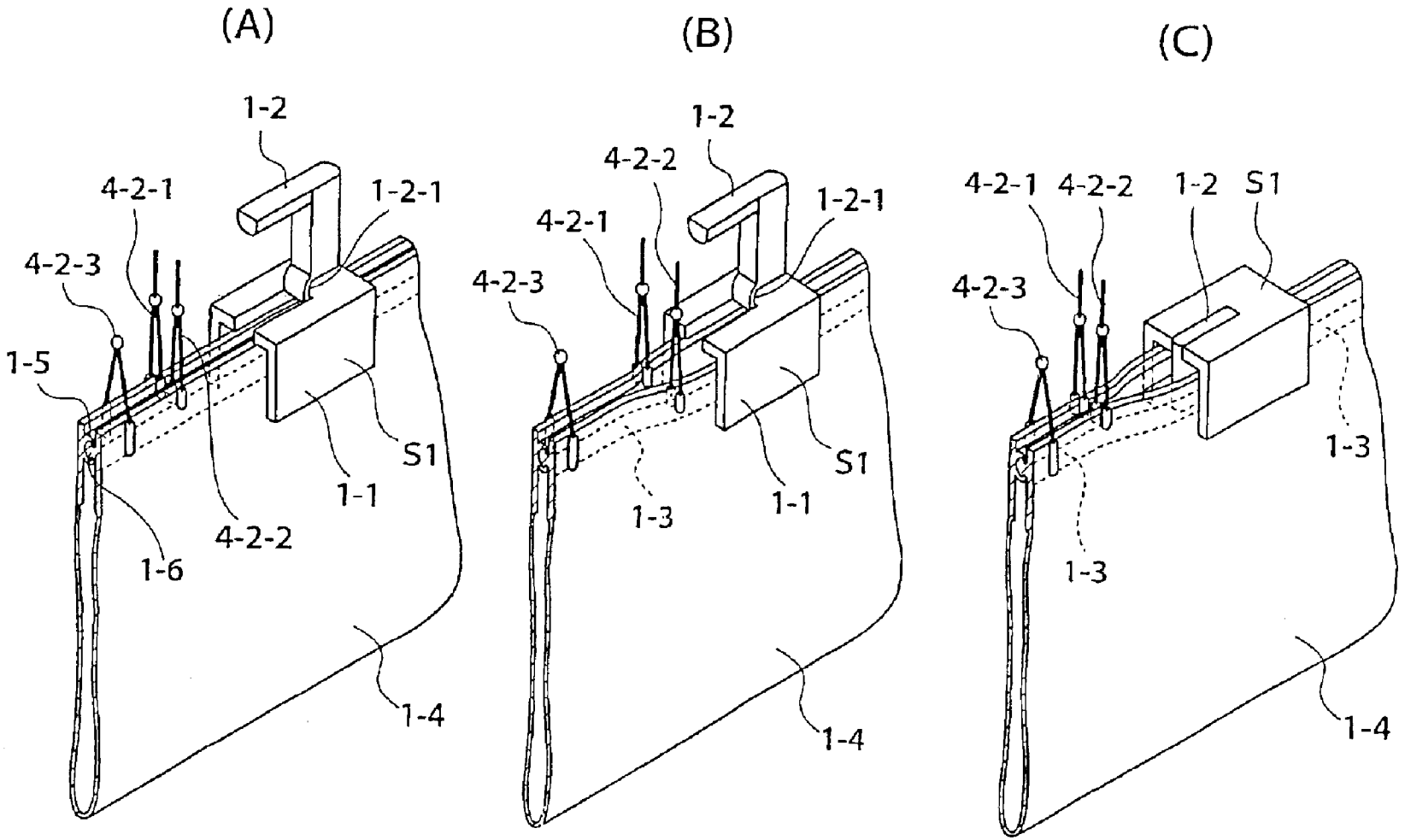
FIG. 11 is a perspective view showing a state of attaching a slider to a zipper portion of the bag body, wherein (A), (B) and (C) are each a perspective view showing a state wherein the outside guide is attached to the zipper portion in (A), a state immediately before the inside guide is rotatably fitted into the outside guide in (B), a state wherein the inside guide is fitted thereinto in (C)
Figure 12:
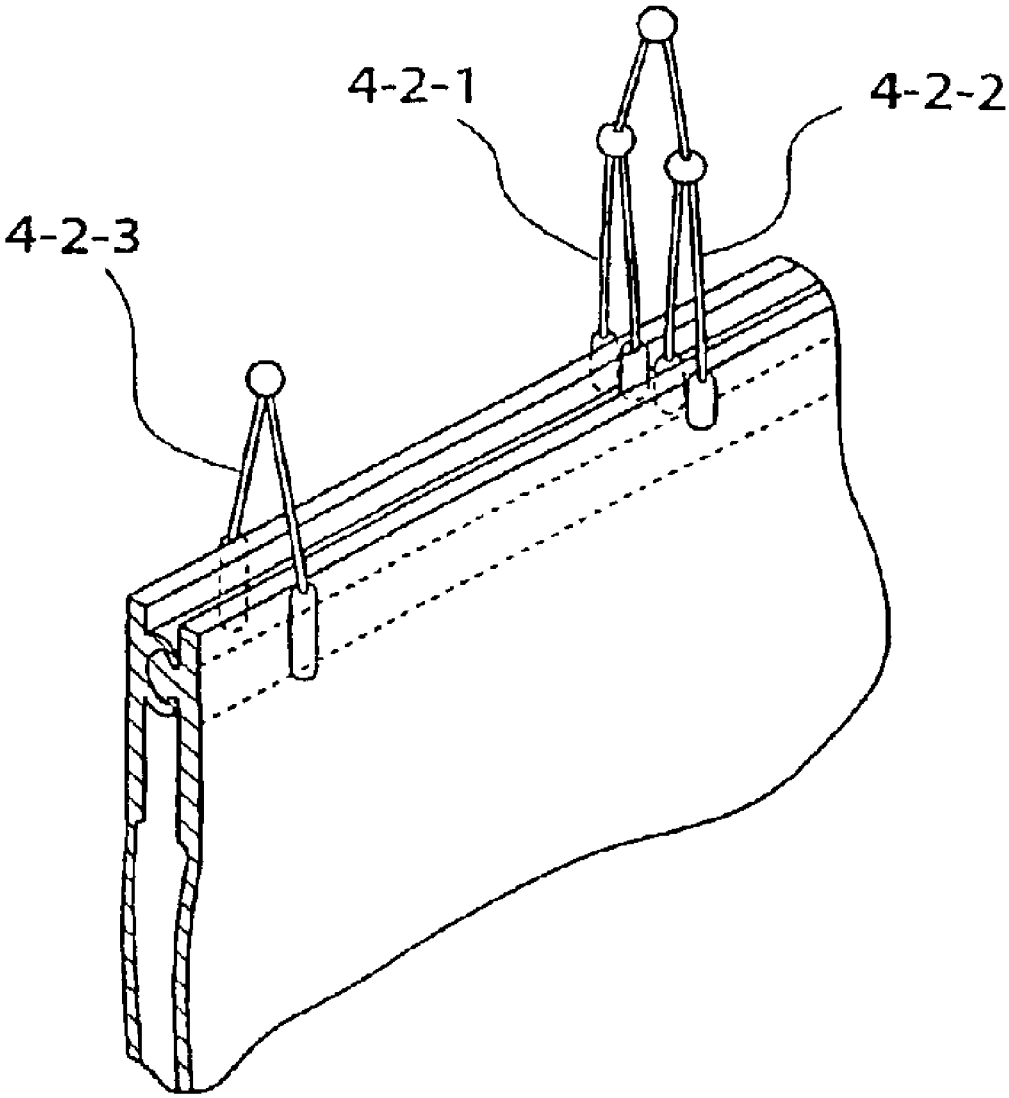
FIG. 12 is a perspective view showing an opening bill as a jig for opening the zipper, and closing bill as a jig for closing the zipper.
Figure 13:
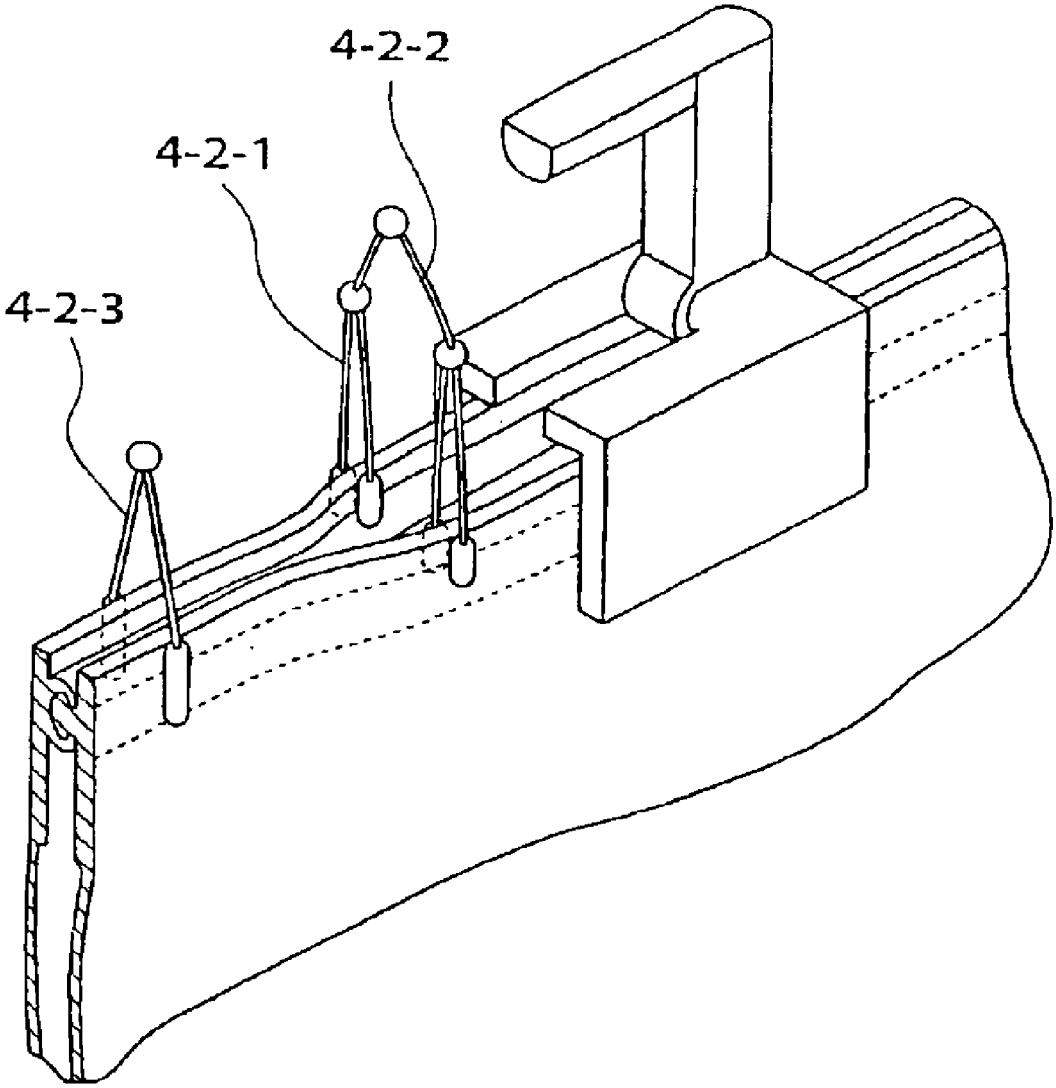
FIG. 13 is a perspective view showing the functioning states of the opening bill and the closing bill immediately before the inside guide of the slider is fitted into the outside guide.
Figure 15:
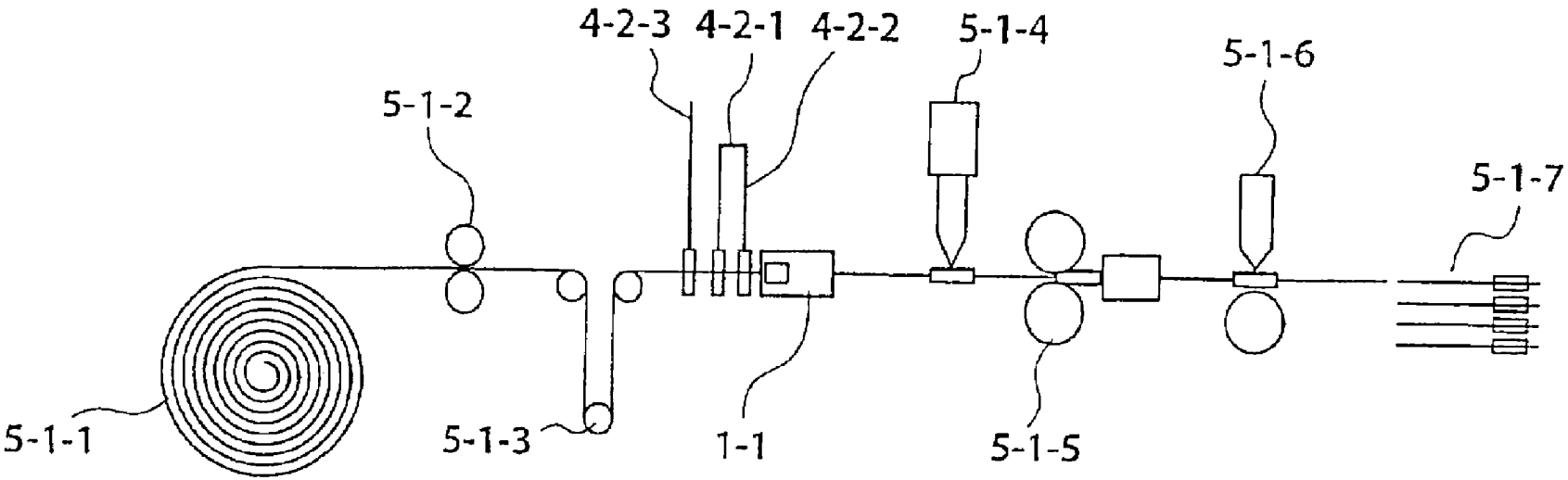
FIG. 15 is a schematic view showing a process for manufacturing bag bodies each equipped with a slider by the use of a bag manufacturing machine of melt cut sealing system.
Figure 16:
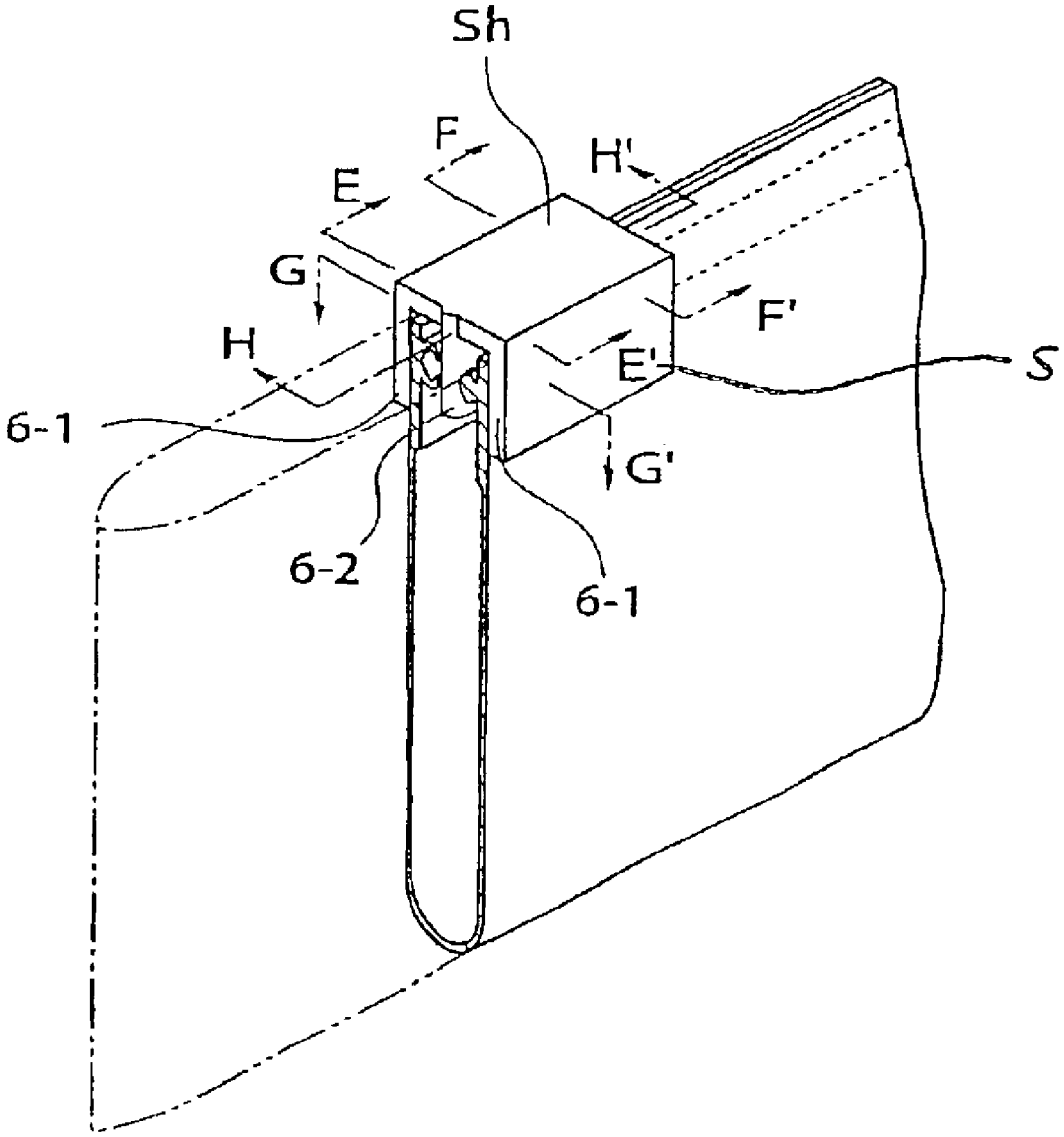
FIG. 16 is a perspective cross sectional view showing the principal portion of a conventional bag body equipped with a slider.
Figure 17:
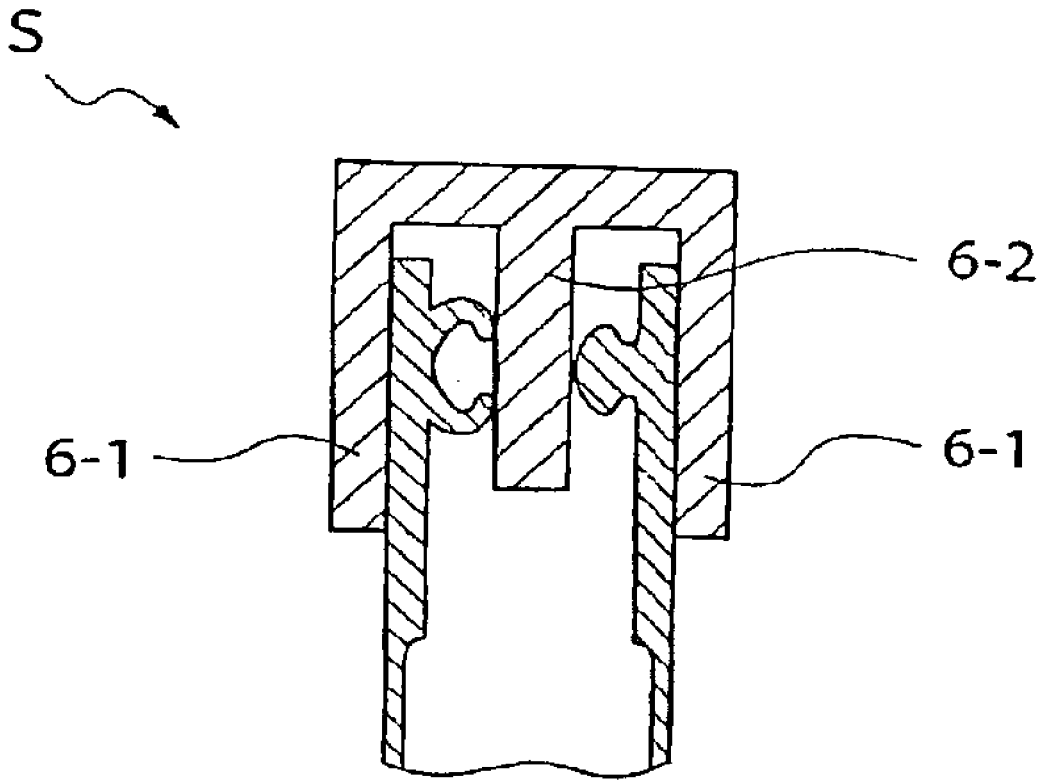
FIG. 17 is a cross sectional view taken along line E–E' of FIG. 16.
Figure 18:
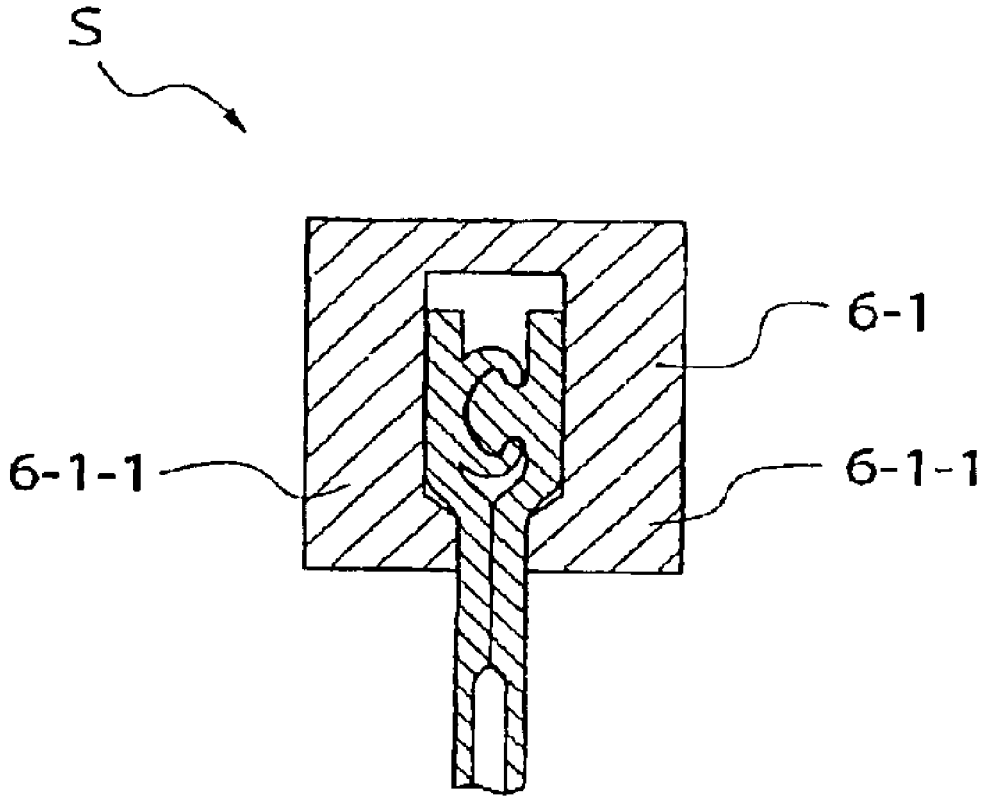
FIG. 18 is a cross sectional view taken along line F–F' of FIG. 16.
Figure 19:
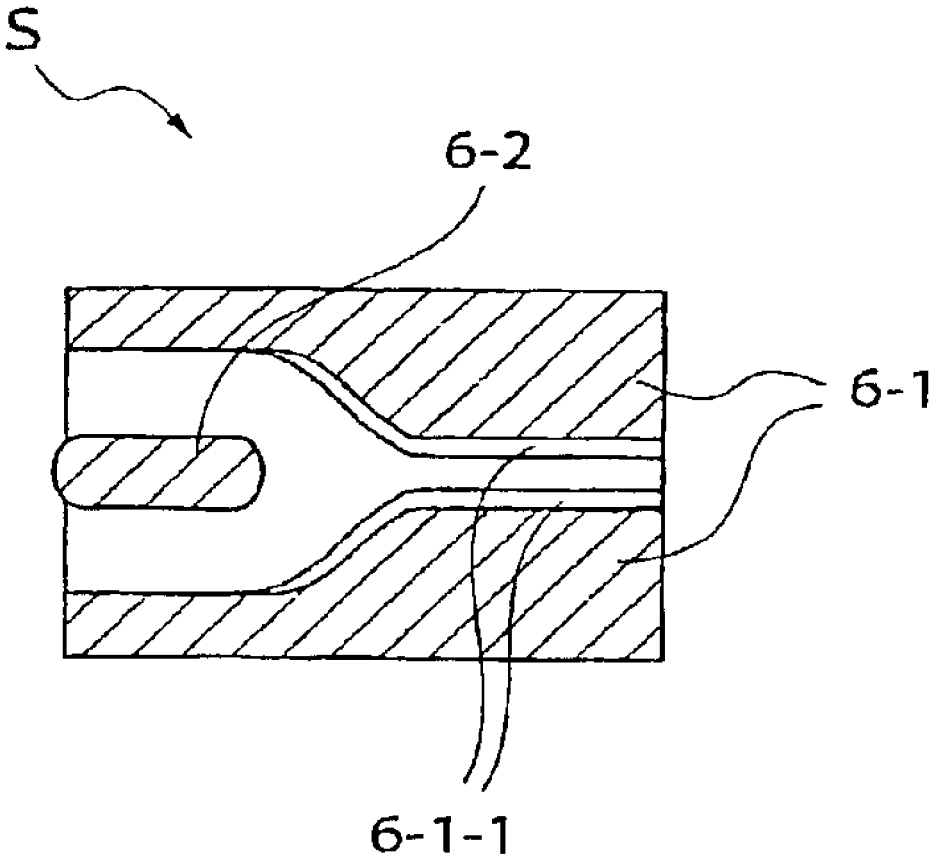
FIG. 19 is a cross sectional view taken along line G–G' of FIG. 16.
Figure 20:
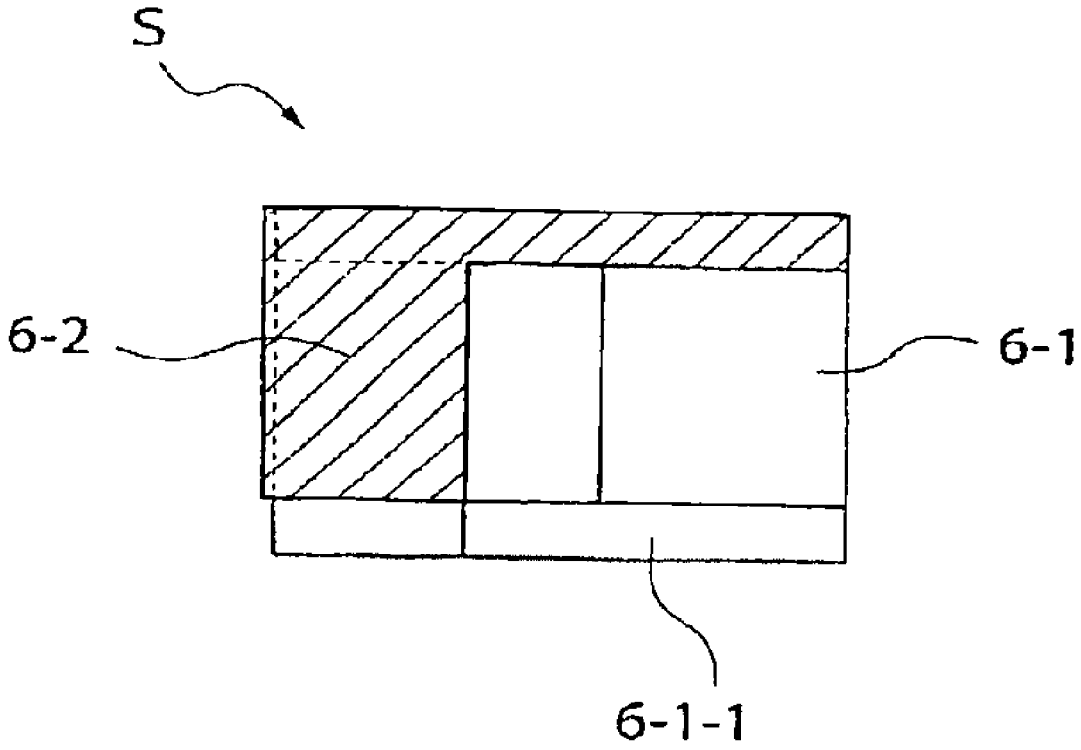
FIG. 20 is a cross sectional view taken along line H–H' of FIG. 16.
Figure 21:
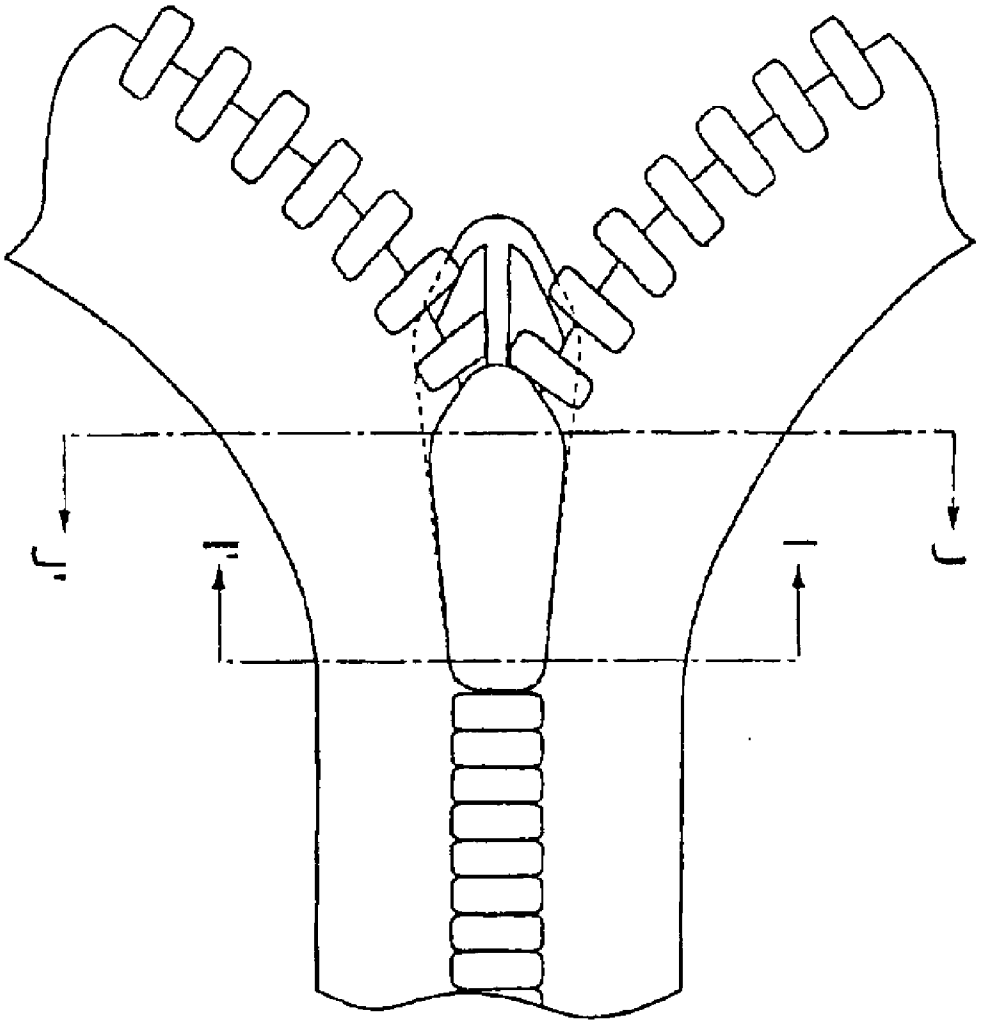
FIG. 21 is a perspective view showing a conventional zipper.
Figure 22:
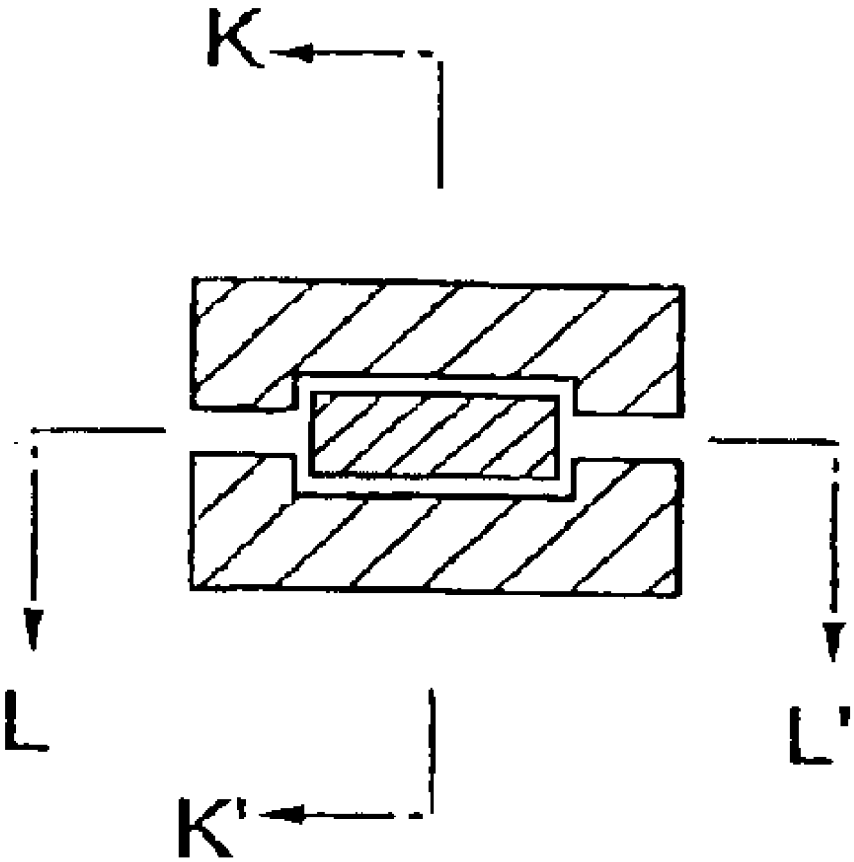
FIG. 22 is a cross sectional view taken along line I–I' of FIG. 21.
Figure 23:
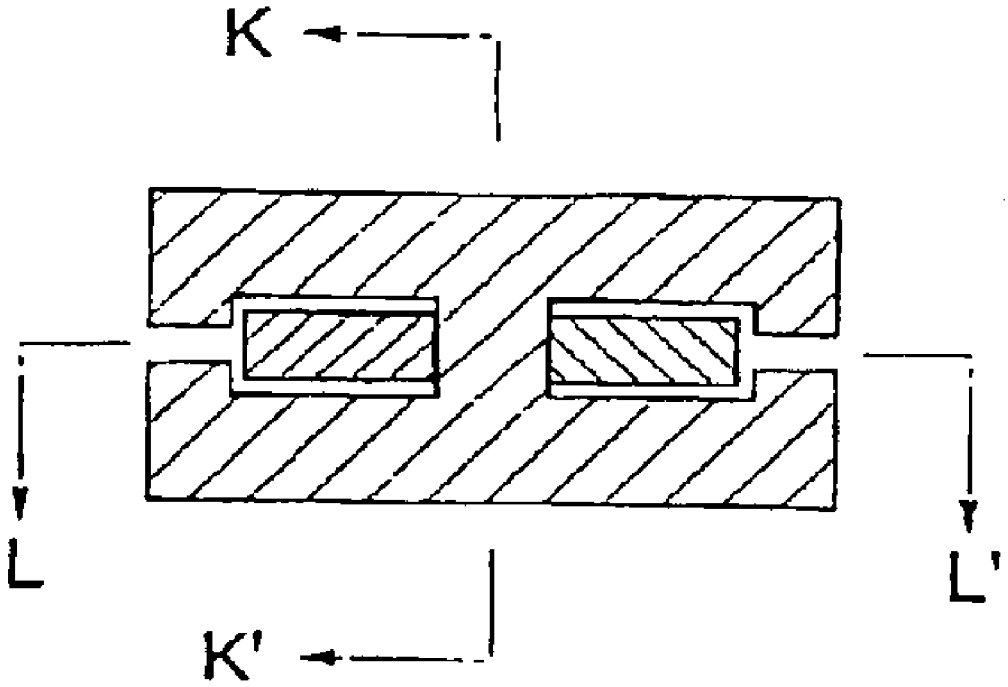
FIG. 23 is a cross sectional view taken along line J–J' of FIG. 21.
Figure 24:
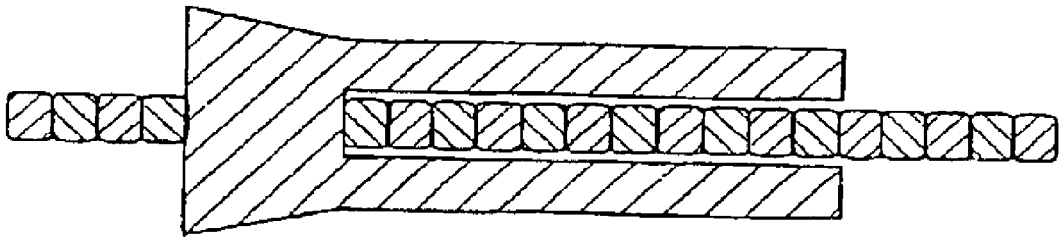
FIG. 24 is a cross sectional view taken along line K–K' of FIG. 21.
Figure 25:
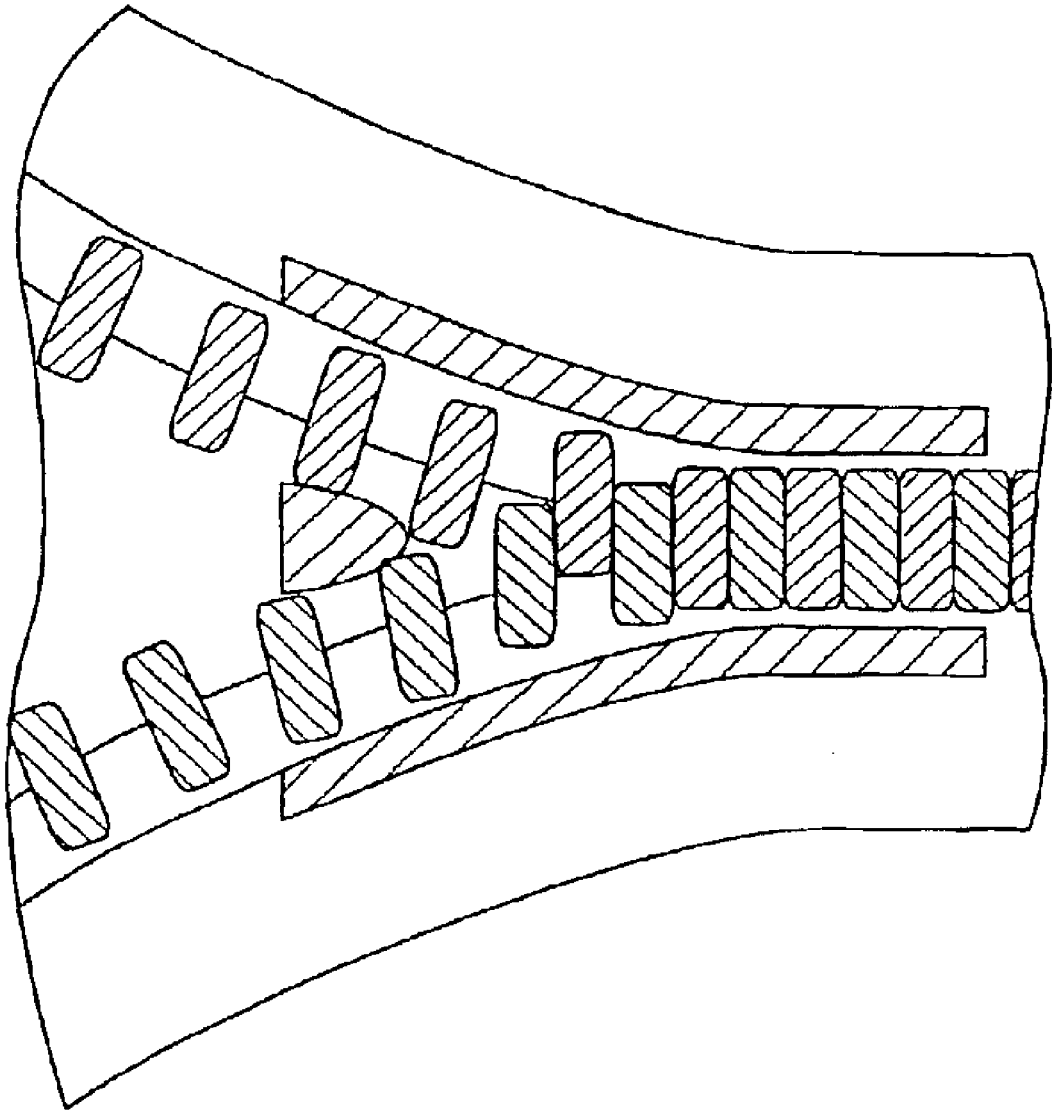
FIG. 25 is a cross sectional view taken along line L–L' of FIG. 21.
Figure 26:
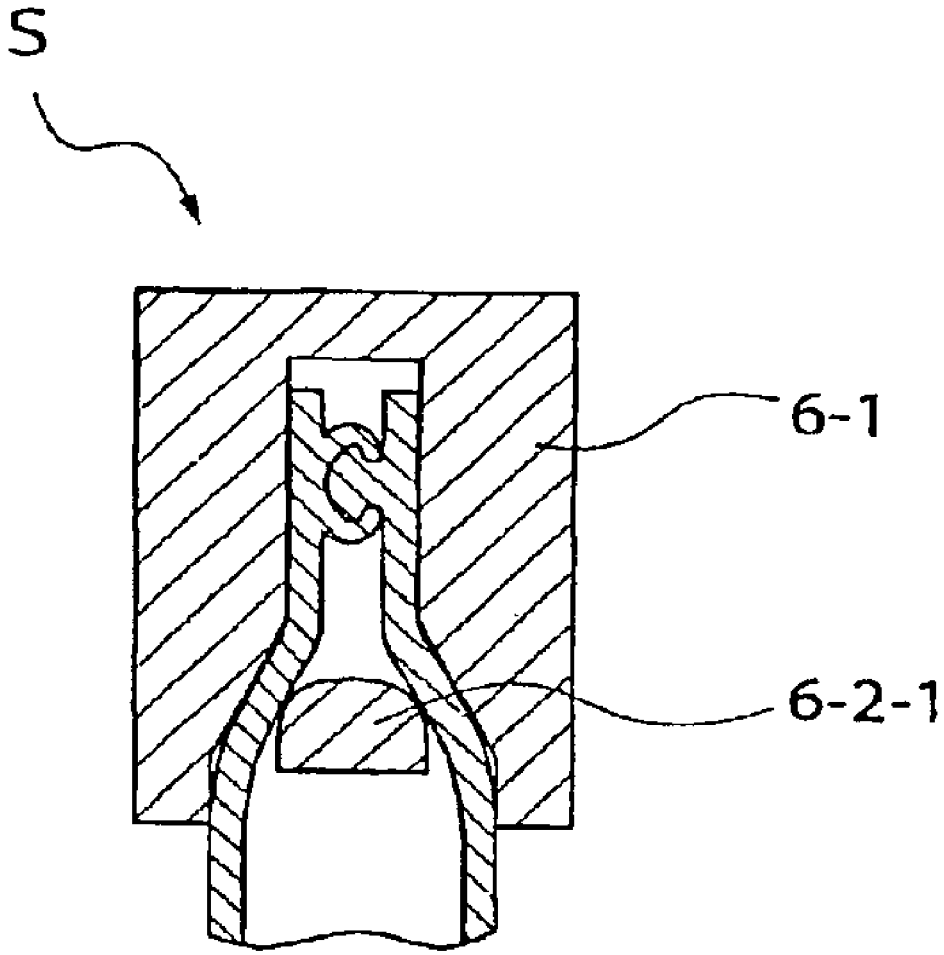
FIG. 26 is a cross sectional view taken along line F–F' of FIG. 16 (similar to FIG. 18) showing an example of a slider for plastic zipper equipped with an anti-falling-off structure as illustrated on FIGS. 21 through 25 for a slider of a zipper.
Figure 27:
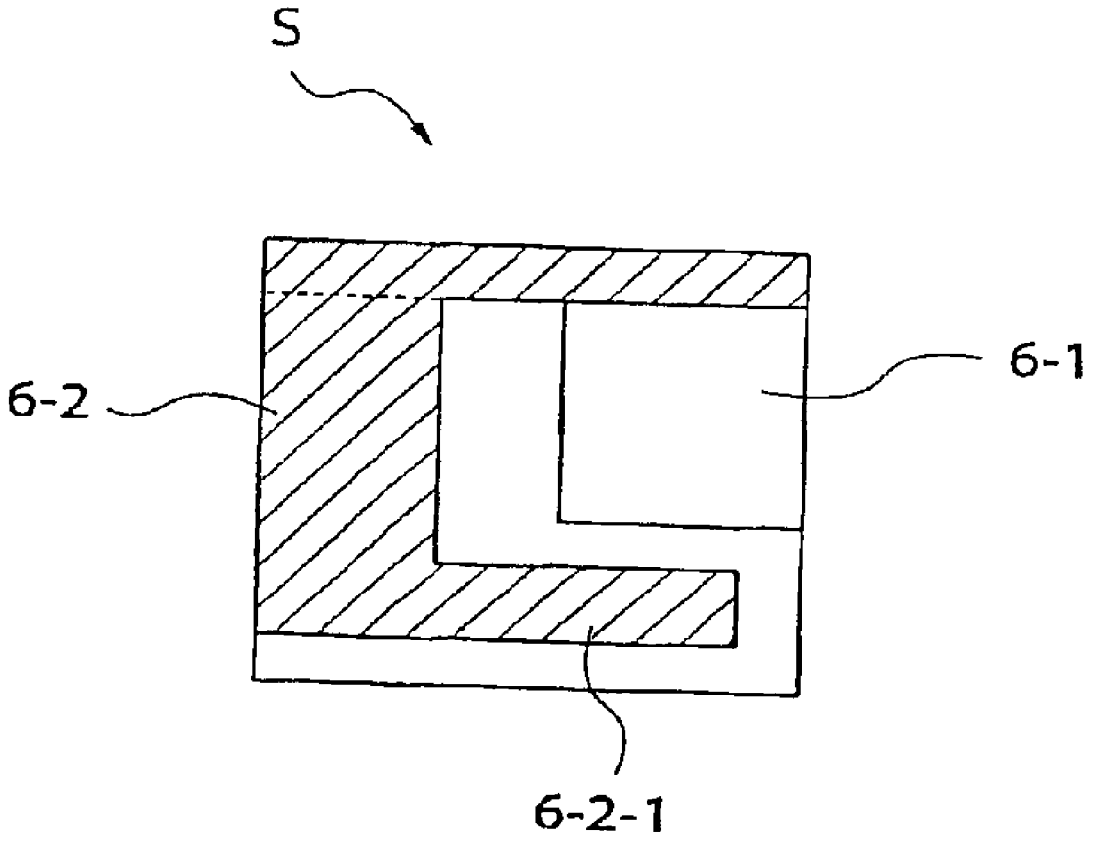
FIG. 27 is a cross sectional view taken along line H–H' of FIG. 16 (similar to FIG. 20) showing an example of a slider for plastic zipper equipped with an anti-falling-off structure as illustrated on FIGS. 21 through 25 for a slider of a zipper

According to the above-described embodiment of the present invention, it is made possible as illustrated on FIG. 15 to attach the slider with the same timing as that of carrying out the melt cut sealing and ultrasonic heat sealing through the installation of the slider attaching equipment as illustrated on FIG. 11 through FIG. 13 between the dancer roll 5-1-3 for the bag manufacturing machine and the ultrasonic heat sealing apparatus 5-1-4. In this case it is necessary to form a cutout on a draw-off roll 5-1-5 so as to enable the slider S1 to pass through.

The embodiment of the present invention, although having been described with reference to the function of a conventional bag manufacturing machine of melt cut sealing system, needless to say, is not limited thereto,

EXAMPLE

A film equipped with a zipper was prepared by attaching a zipper in an engaged state to an end of an LL polyethylene resin film which had a peripheral length of 400 mm and a thickness of 40 micron and which was twice-folded, in which the zipper was made of the material same as that of the film, had a width of 2.2 mm and a thickness of 1.6 mm each in an engaged state, was equipped on the opening side thereof with a flange having a width of 2.0 mm and a thickness of 0.2 mm and an end of which was made to be 0.5 mm wide and 0.7 mm thick. The resultant film with a zipper was wound around a spool.

A slider S1 was made of polypropylene and was composed of an outside guide 1-1 having outside dimensions of 8 mm in width, 10 mm in length, and 11 mm in height each in an assembled state, and an inside guide 1-2 having a maximum width of 2.5 mm, a length of 9 mm and a height of 10 mm.

The slider S1 in a state that the inside guide 1-2 was open as illustrated on FIG. 11(A) and FIG. 11(B) was packed in a parts feeder connected to a slider fitting robot. Thereafter a spool 5-1-1 as exemplified on FIG. 14 was fitted to the bag manufacturing machine, the film with a zipper was let out via the roll 5-1-2, the zipper portion of the film was clipped with the closing bill 4-2-3, and also the outside guide 1-1 of the slider S1 was mounted on the top of the zipper by means of the slider fitting robot. Subsequently, opening bills 4-2-1 and 4-2-2 were opened to open the zipper and thereafter, the inside guide 1-2 of the slider S1 was rotated by 180 degrees from the opening portion of the zipper towards the inside thereof by the use of the slider fitting robot to complete the slider S1.

Simultaneously therewith, the closed zipper portion of the film equipped with the zipper to which the slider S1 had been attached was heat sealed in dimensions measuring 3 mm in width and 6 mm in length by the use of a ultrasonic heat sealing machine. Subsequently, the closing bill 4-2-3 was opened and simultaneously the opening bills 4-2-1 and 4-2-2 were closed. Thereafter the film equipped with the zipper having the slider was moved to the melt cut sealing machine, and the film is sealed and disconnected so that the portion which had been heat sealed by ultrasonic heat sealing was bisected, thereby enabling to manufacture an objective bag body equipped with the zipper having the slider at a manufacturing rate of 67 bags per minutes.

In spite of the bag body which was composed of the LL polyethylene resin film having low strength due to a thickness of only 40 micron and poor sliding properties and of the small zipper having a thickness of only 1.6 mm, it was made possible to manufacture the bag bodies each equipped with the smoothly openable/closable zipper at a high manufacturing rate without any falling-off of a slider.

INDUSTRIAL APPLICABILITY

According to the present invention, it is made possible to manufacture the slider easily attachable to a plastic zipper and the bag body equipped with the aforesaid zipper in spite of the bag body which was composed of thin film with low strength and of the small zipper without any falling-off of a slider by virtue of the specific slider constitution in which an inside guide is openably closably installed on the slider main body and at the same time, the slider is fitted to the zipper so that the inside guide is inserted between the hooks by rotating the same about an axis perpendicularly to the zipper.

What is claimed is:

1. A slider which is attached to a plastic zipper composed of a pair of a male hook and a female hook formed on a surface of plastic films for opening and closing said zipper, comprising:

a slider main body having a cavity therein;

an inside guide fastened to the slider main body by a resilient member, the resilient member configured to allow the inside guide to be rotated about an axis perpendicular to the plastic zipper between a first position outside of the cavity in the slider main body to a second position inside the cavity in the slider main body, the inside guide inserted between said hooks of the plastic zipper and configured to disengage the male hook and female hook from each other by sliding movement of the slider when the inside guide is located in the second position; and an outside guide placed at a position nipping said hooks of the plastic zipper and configured to engage said hooks with each other by the sliding movement of the slider.

2. The slider according to claim 1, wherein the inside guide is installed on part of an upper wall portion of the slider main body via a flexural portion in an openable/closable manner.

3. The slider according to claim 2, wherein the outside guide has a shape configured to prevent the slider from falling-off the zipper by a lower portion of the zipper nipped in the outside guide.

4. A bag body equipped with a plastic zipper having a slider for opening and closing the plastic zipper, wherein the slider is as set forth in claim 3.

5. The slider according to claim 2, wherein the inside guide has a shape configured to be positioned at the outside guide beneath a zipper closing portion when the inside guide is located at the second position.

6. A bag body equipped with a plastic zipper having a slider for opening and closing the plastic zipper, wherein the slider is as set forth in claim 5.

7. A bag body equipped with a plastic zipper having a slider for opening and closing the plastic zipper, wherein the slider is as set forth in claim 2.

8. The slider according to claim 1, wherein the outside guide has a shape configured to prevent the slider from falling-off the zipper by a lower portion of the zipper nipped in the outside guide.

9. A bag body equipped with a plastic zipper having a slider for opening and closing the plastic zipper, wherein the slider is as set forth in claim 8.

10. The slider according to claim 1, wherein the inside guide has a shape configured to be positioned at the outside guide beneath a zipper closing portion when the inside guide is located at the second position.

11. A bag body equipped with a plastic zipper having a slider for opening and closing the plastic zipper, wherein the slider is as set forth in claim 10.

12. A bag body equipped with a plastic zipper having a slider for opening and closing the plastic zipper, wherein the slider is as set forth in claim 1.

13. A process for producing a bag body equipped with a plastic zipper composed of a pair of a male hook and a female hook formed on a surface of plastic films for opening and closing said zipper and a slider including a slider main body having a cavity therein, an inside guide fastened to the slider main body, and an outside guide placed at a position nipping said hooks of the plastic zipper and configured to engage said hooks with each other by the sliding movement of the slider, comprising:

attaching the slider main body to the plastic zipper in a closed state with the inside guide of the slider in a first position outside of the cavity in the slider main body;

opening the zipper; and moving the inside guide to a second position by rotating the inside guide about an axis perpendicular to the plastic zipper into the cavity in the slider main body, the inside guide configured to disengage a male hook and a female hook from each other by sliding movement of the slider when the inside guide is located at the second position.

14. The process according to claim 13, further comprising:

installing the inside guide on part of an upper wall portion of the slider main body via a flexural portion in an openable/closable manner.

15. The process according to claim 13, further comprising:

shaping the outside guide to prevent the slider from falling-off the zipper by a lower portion of the zipper nipped in the outside guide.

16. The process according to claim 13, further comprising:

shaping the inside guide to position the inside guide at the outside guide beneath a zipper closing portion when the inside guide is located at the second position.

17. A bag body equipped with a plastic zipper having a slider for opening and closing the plastic zipper, wherein the slider is made by the process set forth in claim 13.

* * * * *